United States Patent [19]

Alexeff

[11] 4,291,255

[45] Sep. 22, 1981

[54] PLASMA SWITCH

[76] Inventor: Igor Alexeff, 1907 Holston River Rd., Knoxville, Tenn. 37914

[21] Appl. No.: 67,467

[22] Filed: Aug. 17, 1979

[51] Int. Cl.[3] ..... H01J 11/04; H01J 13/48; H05B 37/00; H05B 39/00; H05B 41/00

[52] U.S. Cl. ..... 315/340; 313/231.4; 313/211; 313/183; 315/344; 315/326; 315/56; 361/2; 361/13

[58] Field of Search ..... 313/231.4, 161, 211, 313/209, 183, 184; 315/340, 344, 267, 330, 362, 326, 344.56; 361/2, 13; 200/10, 144

[56] References Cited

U.S. PATENT DOCUMENTS

| | | | |
|---|---|---|---|
| 3,405,300 | 10/1968 | Wasa et al. | 315/344 X |
| 3,604,977 | 9/1971 | Hofmann | 315/267 |
| 3,678,289 | 7/1972 | Lutz et al. | 361/13 |
| 3,939,379 | 2/1976 | Sullivan et al. | 315/330 |
| 3,949,260 | 4/1976 | Bayless et al. | 313/161 |
| 4,034,260 | 7/1977 | Lutz | 315/267 |
| 4,056,836 | 11/1977 | Knauer | 361/2 |

*Primary Examiner*—Saxfield Chatmon, Jr.

[57] ABSTRACT

A plasma switch comprising a substantially evacuated chamber, a generally tubular cathode disposed within the chamber, an elongated anode disposed concentrically within and projecting from the opposite ends of the cathode, the opposite ends of the cathode being substantially closed by an electrically conductive end plates, at least one of such end plates being electrically insulated from the cathode and from the anode, and circuit means for selectively connecting such end plate to the anode or to the cathode.

9 Claims, 3 Drawing Figures

PLASMA SWITCH

The present invention relates to plasma switches and particularly to electrical switches that are capable of interrupting a direct current in a high voltage circuit. More particularly, the present plasma switch in one use is coupled in parallel with switch contacts, having a high voltage direct current flowing therethrough, to extinguish the high voltage arc that forms across the contacts when they open the circuit.

The problem of designing a switch that can operate in series with a large self inductor having a high voltage direct current flowing therethrough, whereby a large voltage develops across the switch contacts when it opens, is a well-known one. Such a switch is needed whenever an inductor is used for energy storage as, for example, in plasma confinement systems, in d.c. to a.c. conversion for d.c. power transmission, or in safety circuits. An ideal switch is a circuit element that when opened brings the current through it to zero instantly and is able to withstand any voltage developed across it.

Practically, however, when a switch opens a high voltage d.c. circuit, a high voltage arc forms across the contacts of the switch, which arc must be extinguished. One method which has been used to extinguish the arc is to couple a secondary plasma switch across the contacts. The plasma switch only carries current when the mechanical contacts are moving apart and therefore is not exposed to high heat dissipation. After the contacts are opened, the plasma switch is opened thus opening the circuit.

One such switch is a crossed field tube or Hughes switch which includes a gas filled tube having therein a tubular anode and a cylindrical cathode disposed within the anode. The gas pressure in the tube is sufficiently low that a gas discharge does not form between the cathode and the anode when the full voltage is applied thereacross. To initiate conduction between the cathode and anode a large magnetic coil surrounding the anode is energized by a magnetic field pulser, causing primary electrons to orbit the cathode. In effect, the electron gas atom collision rate is increased, the low pressure gas breaks down and the device conducts. Removing the magnetic field, turns off the discharge and the switch opens.

Such a cross field tube has several limitations. Special precautions must be taken with the tube design to minimize eddy currents in the vacuum and electrode walls. Eddy currents inhibit the penetration of the field and require external fields well in excess of the internal fields. These precautions are never completely effective and result in increased tube complexity and cost. Also, there is ignition jitter which is related to the time delay between the triggering of the magnetic field pulser and the actual tube ignition. This ignition jitter cannot be easily reduced. Moreover, there is a minimum conduction time which is determined by the time it takes to reduce the internal field from ignition value to the interruption value. To minimize conduction time, special magnetic field circuitry is used to provide an external reverse field to hasten the collapse of the internal field. Also, the magnetic field pulser is costly and complex because of the energy which must be provided to the magnetic field.

Whereas, the present invention is described herein as a plasma switch, in its broader aspects, the present invention constitutes a controllable device for concentrating electrons. Thus the term "plasma switch" as used herein refers to the control over the movement of electrons in a broad sense.

An object of the present invention is to provide a plasma switch. Another object of the invention is the provision for a switch for a high voltage, direct current circuit which is relatively inexpensive and not complex. Another object is to provide a plasma switch for alternating current.

Other objects and advantages of the present invention will become apparent by reference to the following description and accompanying drawings wherein.

Figure 1:
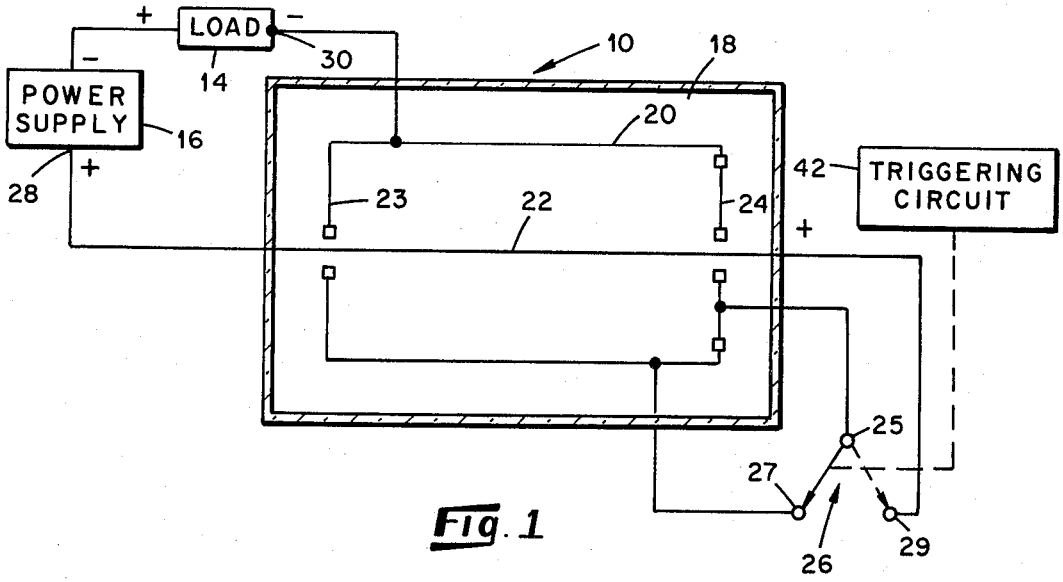
FIG. 1 is a schematic circuit diagram of a direct current circuit employing a switch in accordance with the present invention.

Generally, in accordance with the depicted embodiment of the present invention a switch is provided for interrupting a high voltage direct current in a circuit. An example of such a circuit is shown in the drawings. Referring to FIG. 1, the switch includes a plasma switch 10 connected in in a direct current circuit with a load 14 and a direct current power supply 16. The plasma switch 10 includes a substantially evacuated chamber 18 having therein a tubular cathode 20 and an elongated anode 22 disposed concentrically within the cathode 20. The anode 22 is connected to the positive side of the power supply 16 and the cathode is connected to the negative side, via the load 14. A control end plate 24 of electrically conductive material is disposed at and substantially closes one end of the cathode 20. In the depicted embodiment, the opposite end of the cathode is substantially closed by an end plate 23 that is integrally formed with the tubular cathode. The end plate 24 is connected to the neutral or central terminal 25 of a single pole double throw switch 26. The poles 27 and 29 of the switch 26 are connected to the cathode 20 and anode 22, respectively. The switch 26 is operated by a solenoid (not shown) that is controlled by a triggering circuit 42. Alternatively, the switch 26 may be manually operated. In this embodiment, when the end plate 24 is connected to the cathode 20, the end plate is negatively charged and reflects electrons toward the center of the switch; therefore, electrical conduction occurs between the cathode and anode. However, when the end plate 24 is switched into connection with the anode 22 and is positively charged, there is no conduction between the cathode and anode. Circuit means 26 is provided for selectively connecting the control end plate 24 to the cathode or to the anode.

More particularly, as shown in FIG. 1, the switch 10 is employed to interrupt a high voltage direct current flowing through the load 14 which is an inductive energy storage device. The source 16 of direct current may be a conventional high voltage direct current power supply connected in series with the load 14.

Figure 2:
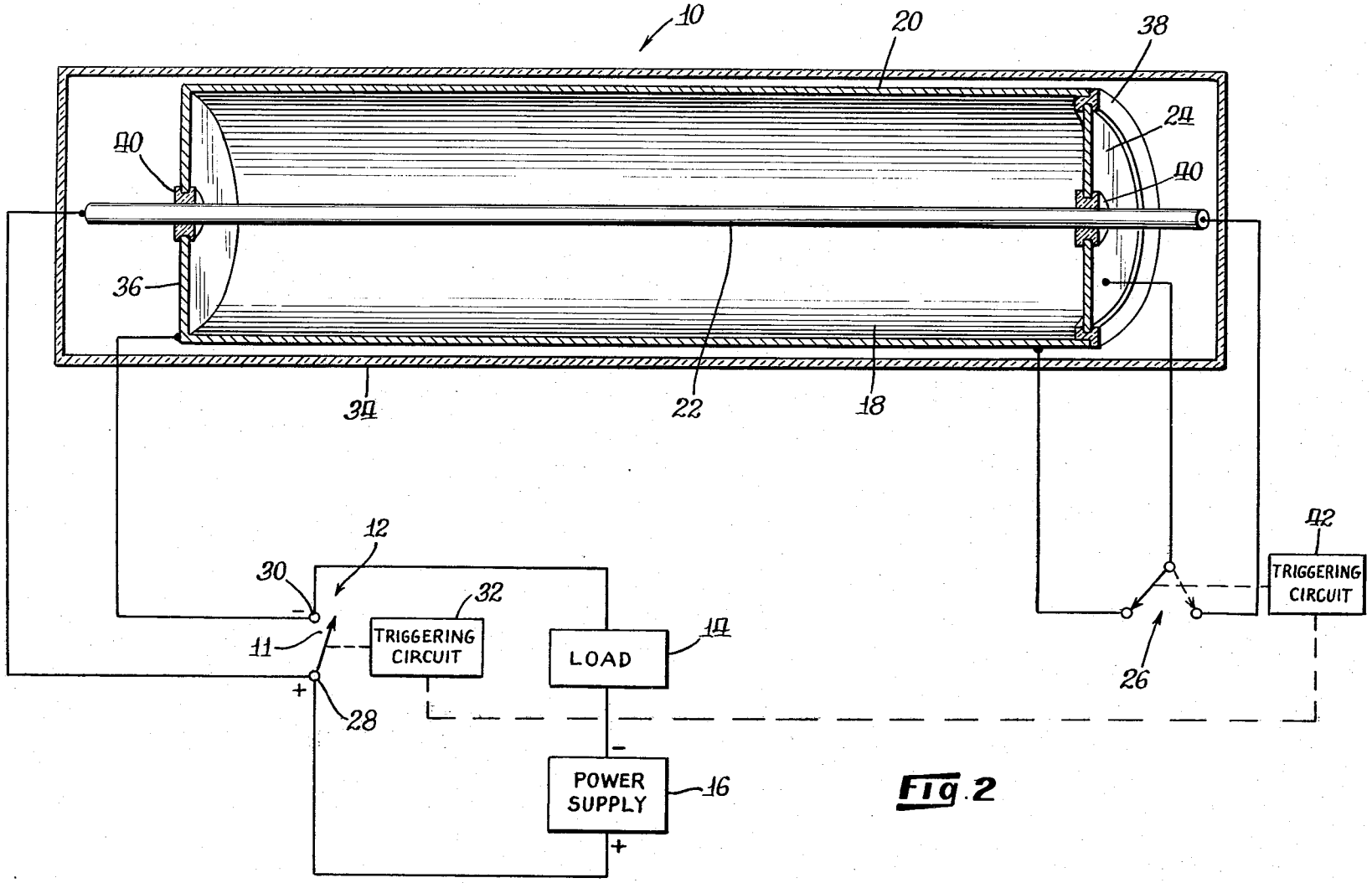
FIG. 2 is a schematic circuit diagram of a plasma switch connected in series with a mechanical switch in a high voltage direct current circuit.

As shown in FIG. 2, a mechanical switch 12 is connected in series with the source 16 and the inductor 14 and includes an input or positive terminal 28 and an output or a negative terminal 30 having the switch contacts 11 coupled therebetween. The mechanical switch is operated by a solenoid (not shown) which is energized by the energization of a triggering circuit 32.

Connected across the switch contacts 11 is the plasma switch 10. As shown in FIG. 2, the plasma switch 10 includes the substantially evacuated chamber 18 which is provided by a tube 34 of insulating material such as glass. Any suitable gas which is easily ionized, such as deuterium, nitrogen, etc. may be used to partially back-full the chamber but it has been found that residual air within the chamber provides a usable ionizable medium down to pressures approximating $10^{-6}$ Torr. Suitably supported within the tube 34 is the tubular cathode 20 which is connected to the negative terminal 30. The cathode 20 is formed by a tube of conductive material, such as copper, one end of which is closed by an integrally connected, conductive end plate 36 which also may be made of copper.

The other end of the tubular cathode 20 is provided with the circular control end plate 24 which is made of conductive material, such as copper. The control end plate is smaller in diameter than the internal diameter of the cathode and is suitably supported and insulated from the cathode 20 by a ring 38 of insulating material, such as glass. In certain applications, the other end plate 36 may be insulated from the cathode 20 and also used as a control end plate or current-carrying electrode.

Extending coaxially through the tubular cathode 20 is the anode 22 which, as illustrated, is an elongated rod of conductive material, such as copper or tungsten, extending through the end plate 36 and the control plate 24. The anode 22 is suitably supported and insulated from the plates 36 and 24 by insulators 40. The anode 22 is connected to the positive input terminal 28. The diametral dimension of the depicted anode is relatively small, i.e., less than about 0.01 inch, to minimize electron collision therewith when the end plate is negative or neutral.

The control end plate 24 is selectively connected to the cathode 20 or to the anode 22 by the switch means 26. In the illustrated embodiment, the switch means 26 is a single pole, double throw switch having its common terminal connected to the control end plate 24 and its poles respectively connected to the anode 22 and the cathode 20. The switch 26 is operated by a solenoid (not shown) which is energized by a triggering circuit 42. This triggering circuit is electrically connected to the triggering circuit 32 such that when the switch 12 is opened, there is a correlated opening of the switch 26 to connect the end plate 24 to the anode 22.

In operation, when the mechanical switch 12 is closed, the switch means 26 is in its position that connects the control end plate 24 to the cathode 20. In this state, the negatively charged end plate 24 reflects electrons toward the center of the switch. When it is desired to open the circuit, the mechanical switch 12 is opened, and the resulting high voltage developed across the anode 22 and cathode 20 of the plasma switch causes a discharge therebetween. The discharge between the anode 22 and the cathode 20 is thereafter extinguished by causing the switch means 26 to switch to its position where the control end plate 24 is connected to the anode 22. The connection of the end plate 24 to the anode 22 is maintained only when the mechanical switch 12 is opened by the triggering circuit 42. When the switch 12 is closed, then switch 26 effects reconnection of the end plate 24 to the cathode 20 for accommodating a subsequent opening of the switch 12.

The pressure of the gas in the chamber 18 should be sufficiently low so that there is conduction at full voltage between the anode 22 and the cathode 20 when the control end plate 24 is negatively charged, but there is no conduction when the control end plate 24 is connected to the anode 22, i.e., is positively charged.

In one illustrative embodiment, the cathode is formed of a cylinder of aluminum foil about 6 inches long, about 2 inches in outer diameter and slightly less than 2 inches in inner diameter. The anode is a wire of tungsten having a diameter of 0.006 inches. The chamber is evacuated to a pressure of $10^{-6}$ Torr. In one embodiment, the chamber is back-filled with argon to a pressure of $10^{-5}$ Torr. The aperture in the control end plate is $\frac{1}{8}$ inch in diameter. The plasma switch is employed to extinguish an arc across a mechanical switch which has 500 milliamperes of direct current flowing therethrough and at opening 1.5 kilovolts is developed across the switch contacts. The foregoing described embodiment has been employed also to extinguish the arc across mechanical switch contacts in a circuit carrying a load of about 10 kilovolts. It will be recognized, however, that substantially larger cathodes and anodes may be employed.

The plasma switch requires a switching current to the control plate of only about 1 to 5% of the main discharge current. The ratio of switching current to discharge current can be reduced by reducing the diameter to length ratio of the cathode. The plasma switch is less expensive and less complex than the prior art plasma devices and switches faster.

Figure 3:
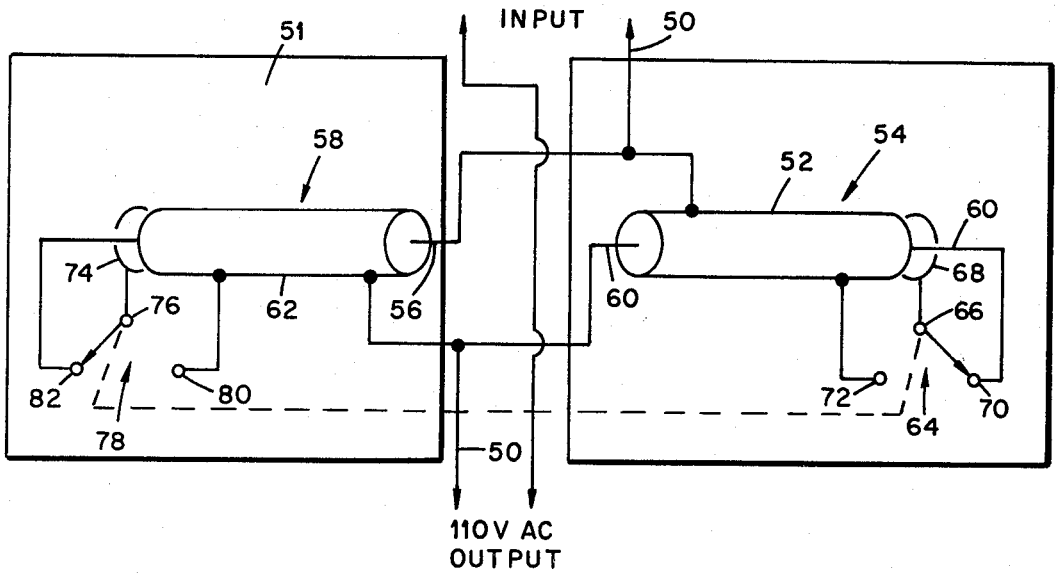
FIG. 3 is a schematic circuit diagram of two plasma switches connected in an alternating current circuit.

With reference to FIG. 3, the present plasma switch may be employed to switch an alternating current (a.c.) by connecting two of the present devices in "back to back" relationship in an a.c. circuit. As depicted in FIG. 3, one leg 50 of the high-voltage a.c. circuit has interposed along its length first and second plasma switch devices 54 and 58 that are each housed in substantially evacuated chambers 51 and 53. The input portion of the leg 50 is connected both to the outer tubular electrode 52 of the first plasma switch device 54 and to the central electrode 56 of the second plasma switch device 58. Further, the central electrode 60 of the first plasma switch device 54 and the outer electrode 62 of the second plasma switch device 58 are connected to the output portion of the leg 50. The first plasma switch device 54 is provided with a single pole double throw switch 64, the common pole 66 of which is connected to the end plate 68 of the plasma switch device 54. A further one of the poles 70 of the switch 64 is connected to the central electrode 60. Still further, the pole 72 of the switch 64 is connected to the outer electrode 52.

In like manner, the end plate 74 of the second plasma switch device 58 is connected to the common pole 76 of a single pole double throw switch 78. One of the poles 80 of the switch 78 is connected to the outer electrode 62 of the plasma switch 58. The other of the poles 82 of the switch 78 is connected to the central electrode 56. The switches 64 and 78, as shown, are ganged for simultaneous operation.

In operation of the a.c. switch depicted in FIG. 3, when the ganged switches 64 and 78 are in the position as depicted in FIG. 3, that is, the respective end plates are connected to the respective central electrodes of the two plasma switches, the "switch" is opened and there is no conduction between the high voltage a.c. input and the high voltage a.c. output. Under these conditions, on the negative half of the a.c. cycle, there is no conduction between the central electrode and outer electrode of the first plasma switch 54 because the end plate is switched to the central electrode, biasing the end plate positively so that there is no conduction between the electrodes of the first plasma switch. Simultaneously, on the negative half of the a.c. cycle, the second plasma switch 58 does not conduct, because the central electrode is negatively biased and electron confinement does not occur. Thus there is no conduction "backward" through the plasma switch.

On the other hand, on the positive half of the a.c. cycle, in the first plasma switch 54, the central electrode is biased negatively and the end plate is switched thereto so that the end plate is also biased negatively and there is no backward conduction through this first device. Further, on the positive half of the a.c. cycle, in the second plasma switch 58, the end plate is connected to the positively charged central electrode and there is no conduction between the electrodes of the second plasma switch.

However, when the end plates 68 and 74 are both switched to be connected to the outer electrodes of the two plasma switches, the first plasma switch 54 conducts during the negative half of the a.c. cycle and the second plasma conducts during the positive half of the a.c. cycle so that the circuit is then closed and there is conduction between the input and output in the high voltage a.c. circuit.

Various changes and modifications may be made in the above described switch without deviating from the spirit or scope of the present invention. Various features of the invention are set forth in the following claims.

What is claimed:

1. A plasma switch including means for defining a substantially evacuated chamber, a tubular cathode disposed within said chamber, an elongated anode disposed within said cathode, a first conductive end plate disposed at one end of said cathode insulated from said anode and said cathode and substantially closing said one end of said cathode, means substantially closing the opposite end of said cathode, and means for selectively connecting said first end plate to said anode or to said cathode.

2. A plasma switch in accordance with claim 1 wherein said means closing the opposite end of said cathode comprises a second end plate, said second end plate being switchably connected to said cathode and to said anode.

3. A plasma switch in accordance with claim 1 or 2 wherein the anode extends coaxially of said cathode.

4. A plasma switch in accordance with claim 1 wherein said chamber is evacuated to a pressure of at least about $10^{-5}$ Torr.

5. A plasma switch in accordance with claim 1 wherein said chamber is partially back-filled with an ionizable gas to a pressure of about $10^{31\ 5}$ Torr.

6. A plasma switch in accordance with claim 1 wherein said anode comprises an elongated metallic conductor having a maximum diametral dimension of less than about 0.01 inch.

7. The plasma switch of claim 1 and including switch contacts, means connecting one of said switch contacts to said cathode, means connecting the other of said switch contacts to said anode, and circuit means correlating the opening and closing of said switch contacts with the selective connecting of said first end plate to said anode and to said cathode, whereby when said switch contacts are open, said first end plate is connected to said cathode for a relatively short time to interrupt the arc at the contacts following which the end plate is reconnected to the anode.

8. A plasma switch comprising a substantially evacuated closed housing means, a tubular first electrode substantially closed at its opposite ends by electrically conductive respective end plates and disposed within said housing means, an elongated second electrode disposed within and substantially concentrically of said first electrode, means electrically insulating one of said end plates from said first and second electrodes, switch means for selectively connecting said end plate to said first electrode or second electrode.

9. Switch means for an alternating current circuit comprising first and second electrical conductors connected to a source of alternating current, first and second plasma switch devices interposed along the length of said first conductor, each of said plasma switches being housed in a substantially evacuated chamber and comprising a substantially tubular first electrode that is substantially closed at its opposite ends by electrically conductive respective end plates, an elongated second electrode disposed within said first electrode and substantially concentrically of said first electrode, means electrically insulating one of said end plates from said first and second electrodes, switch means for selectively connecting said end plate electrically to said first electrode or said second electrode, means electrically connecting the input portion of said conductor to said outer electrode of said first plasma switch and to said central electrode of said second plasma switch, means electrically connecting the output portion of said first conductor to said central electrode of said first plasma switch and to said outer electrode of said second plasma switch, and means for substantially simultaneously operating said switch means to electrically connect said end plates to said outer electrodes or to said central electrodes of said plasma switches.

* * * * *

UNITED STATES PATENT OFFICE

CERTIFICATE OF CORRECTION

Patent No. 4,291,255 Dated September 22, 1981

Inventor(s) Igor Alexeff

It is certified that error appears in the above-identified patent and that said Letters Patent are hereby corrected as shown below:

Claim 5, line 3, change "$10^{31\ 5}$" to -- $10^{-5}$ --.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*